US009217315B2

(12) United States Patent
Møgedal

(10) Patent No.: US 9,217,315 B2
(45) Date of Patent: Dec. 22, 2015

(54) SUBSEA WELL TEMPLATE

(75) Inventor: Knut Møgedal, Asker (NO)

(73) Assignee: Aker Subsea AS, Lysaker (NO)

( * ) Notice: Subject to any disclaimer, the term of this patent is extended or adjusted under 35 U.S.C. 154(b) by 275 days.

(21) Appl. No.: 13/202,604

(22) PCT Filed: Mar. 9, 2010

(86) PCT No.: PCT/EP2010/052977

§ 371 (c)(1),
(2), (4) Date: Aug. 22, 2011

(87) PCT Pub. No.: WO2010/103002

PCT Pub. Date: Sep. 16, 2010

(65) Prior Publication Data

US 2011/0303417 A1 Dec. 15, 2011

(30) Foreign Application Priority Data

Mar. 10, 2009 (NO) ..... 20091048

(51) Int. Cl.
*E21B 41/08* (2006.01)
*E21B 33/037* (2006.01)

(52) U.S. Cl.
CPC ..... *E21B 41/08* (2013.01); *E21B 33/037* (2013.01)

(58) Field of Classification Search
CPC ... E21B 33/035; E21B 33/038; E21B 33/043; E21B 34/04; E21B 17/02; E21B 43/0122; E21B 43/013; E21B 21/001; E21B 33/037; E21B 43/0107; E21B 43/12
USPC ..... 166/338, 344, 345, 351, 360, 368, 378, 166/85.1
See application file for complete search history.

(56) References Cited

U.S. PATENT DOCUMENTS 1,830,061 A * 11/1931 Howe ..... 166/79.1
2,022,267 A * 11/1935 Zeek ..... E21B 33/037 138/89
2,532,341 A * 12/1950 Shannon ..... E21B 33/037 166/96.1
3,063,500 A * 11/1962 Logan ..... E21B 33/037 166/351
3,247,672 A * 4/1966 Johnson ..... B63C 11/44 166/351
3,353,364 A * 11/1967 Blanding ..... B63C 11/44 114/314
3,461,957 A * 8/1969 West ..... E21B 33/037 166/351

(Continued)

FOREIGN PATENT DOCUMENTS

CA 2508559 A1 11/2005
GB 2194980 A 3/1988

(Continued)

OTHER PUBLICATIONS

Strømmen, Henrik, "International Search Report", for PCT/EP2010/052977, as mailed Jul. 5, 2011, 4 pages.

*Primary Examiner* — Matthew Buck
*Assistant Examiner* — Edwin Toledo-Duran
(74) *Attorney, Agent, or Firm* — Winstead PC

(57) ABSTRACT

Subsea well template comprising a plurality of well slots arranged adjacent to a manifold reception space, said template comprising a plurality of template hatches for protection of well components, including a Xmas tree. Said hatches comprise at least a top protection cover and a side protection panel. The hatches are arranged to pivot between a closed and open position, about a pivot axis arranged at a lower end of the hatch. When in an open position, the well template exhibits absence of a framework extending up towards the top of the template.

10 Claims, 8 Drawing Sheets

(56) References Cited

U.S. PATENT DOCUMENTS 3,592,263 A * 7/1971 Nelson ..... E21B 33/037 166/351
3,703,207 A * 11/1972 Horton ..... E21B 33/037 166/337
3,866,676 A * 2/1975 Burns ..... E21B 33/037 166/363
3,910,056 A * 10/1975 Dopyera ..... F16L 1/123 405/211
3,968,656 A * 7/1976 Kalinowski ..... B63C 11/40 166/356
4,220,421 A * 9/1980 Thorne ..... E02B 3/127 166/368
4,258,794 A * 3/1981 Sizer ..... B63C 11/40 166/347
4,273,472 A * 6/1981 Piazza ..... E21B 33/037 166/356
4,323,118 A * 4/1982 Bergmann ..... E21B 33/02 166/356
4,437,521 A * 3/1984 Richardson ..... E21B 41/06 166/341
4,519,727 A * 5/1985 Mitchell ..... E21B 33/037 166/335
4,669,536 A * 6/1987 Ames ..... E21B 33/03 166/105
4,687,377 A * 8/1987 Langner ..... F16L 1/15 166/338
4,919,210 A * 4/1990 Schaefer, Jr. ..... E21B 33/037 166/356
5,176,471 A * 1/1993 Frafjord ..... E21B 43/017 166/356
5,299,641 A * 4/1994 Paulo et al. ..... 166/341
5,494,110 A * 2/1996 Appleford ..... E21B 33/038 166/339
5,810,515 A * 9/1998 Fredriksen ..... E21B 43/017 166/356
6,889,770 B2 * 5/2005 Qvam ..... E21B 36/003 166/356
7,051,804 B1 * 5/2006 Arning ..... E21B 33/037 166/399
7,419,006 B2 * 9/2008 Armstrong ..... E21B 41/0021 166/338
7,635,031 B2 * 12/2009 Davison ..... E21B 17/1071 166/241.4
8,555,979 B1 * 10/2013 Milanovich ..... E21B 33/037 166/339
2003/0010499 A1 * 1/2003 Qvam ..... E21B 36/003 166/335
2012/0037378 A1 * 2/2012 Fenton ..... E21B 33/037 166/360

FOREIGN PATENT DOCUMENTS

GB 2426266 A 11/2006
NO 177647 3/1993
NO 944507 A 5/1996
WO WO-02/075103 A1 9/2002
WO WO-03044316 A1 5/2003
WO WO-03/071092 A1 8/2003

* cited by examiner

SUBSEA WELL TEMPLATE

The present invention relates to templates for subsea wells. In particular, the invention relates to a configuration of template hatches for protection of Xmas trees and other equipment inside.

BACKGROUND

It is common to arrange subsea wells in protective subsea well templates with a plurality of well slots. For instance, the template can comprise four well slots, wherein two slots are arranged on each side of a manifold arranged in between. In order to have access to well equipment, such as the Xmas trees, hatches are arranged above the slots, which can be pivoted or lifted away.

Such a template is shown in the accompanying FIG. 1, illustrating a template with four well slots and pivotable hatches that are suspended to a robust framework. The top of the template fluctuates with the top cover of a manifold arranged between the two pairs of well slots. For the discussion here and further below, the manifold is said to have a longitudinal axis being parallel to the lines between the two well slots in each pair of slots (being on separate sides of the manifold).

The vertical sides of the template are open for access to the Xmas trees with an ROV, through openings below the upper frame bar. With the shown template, an ROV can access the Xmas tree from two sides, namely from the side being opposite of the side facing the manifold and the side facing the directions parallel to the longitudinal axis of the manifold.

The hatches pivot about a pivot axis being perpendicular to the longitudinal axis of the manifold. Thus, when a hatch is in an opened position, the ROV will preferably access a Xmas tree from the side being opposite of the manifold in order to avoid any interference with the hatch.

When the manifold is being lowered down into the template, all hatches will preferably be in an open position in order to avoid collision with the manifold. One should note that the upper framework needs to be dimensioned to make space for the manifold when it is being lowered or pulled up.

Patent publication NO177647 describes another protective structure for subsea equipment. The structure has a robust framework on top of which are arranged a plurality of pivotable hatches.

Another embodiment of a protective device for subsea installations is described in international patent application WO 03044316. This device has a top cover with a lattice, and four inclined and latticed side covers that extend up to the top of the device from a lower position. The side covers are hinged at the lower position, enabling them to pivot out from the device to an open position.

The object of the present invention is to provide a subsea well template which can accommodate a manifold and with a plurality of well slots, which template combines efficient protection of the subsea equipment inside while providing efficient operation access, such as for an ROV.

THE INVENTION

The present invention provides a subsea well template comprising a plurality of well slots arranged adjacent to a manifold reception space, wherein the template comprises a plurality of template hatches for protection of well components, including a Xmas tree. The hatches comprise at least a top protection cover and a side protection panel.

Preferably the template has no remaining framework structures extending up towards the top of the template when the hatches are in an open position.

This configuration of the hatches results in a plurality of advantages. For instance, one hatch will provide top and side protection of the subsea equipment, while still providing access both from above and from the side when being in an open position. Furthermore, one avoids having a remaining framework in the region of the subsea equipment when the hatches are opened. This leaves more space and freedom of movement for other operating equipment, such as an ROV. This advantage also relates to the installation of a manifold to be arranged in between the well slots, as will become apparent from the discussion of the example of embodiment.

The omission of a framework surrounding the subsea equipment when the hatches are in the open position makes it possible to use a smaller template than in the prior art. This is because the frameworks used in the prior art solutions have to be sufficiently large to provide access from an ROV in between the framework elements.

Furthermore, by providing the hatches with side protection panel, trawl doors or trawl otter boards will not be hooked to any framework bar. Instead, when hitting the template, they will simply slide upwards along the side protection panel until moving free of the template. In the prior art framework templates, a trawl door could get hooked, resulting in extremely large forces being applied in order to pivot the trawl door about the framework bar before it was released. Thus, the subsea template according to the present invention will not be exposed to such extreme forces.

Due to the requirement of being overtrawlable, the template should be provided with inclined faces leading to the top of the template structure. Because of the omission of the upwardly extending framework, these inclined faces can start further in (or lower, respectively) on the template than what would be possible with a framework template. This feature also contributes in making the template smaller than the prior art solutions.

Preferably, the hatches of the template are arranged to pivot between a closed and open position about a pivot axis arranged at a lower end of the hatch when in the closed position.

Advantageously a manifold reception space is arranged to receive a manifold with a longitudinal direction, wherein said hatches are adapted to pivot between a closed and open position, about a pivot axis extending substantially parallel to said longitudinal direction. By pivoting the hatches in this direction, they will be removed from the manifold reception space when installing or removing the manifold.

Preferably the pivot axis is arranged below an ROV operation space, said operation space being capable of accommodating an ROV that is situated to operate an ROV interface of said Xmas tree. Thus when a hatch is pivoted to the open position, an ROV can be positioned above the side protection panel and the pivot axis or hinges when in an operation position. In such a position, it can for instance operate an instrument panel on a Xmas tree arranged in a well slot.

The side protection panel can advantageously comprise a primary door hingedly attached to the hatch. This feature provide ROV access to subsea equipment in the template even if the hatch is in a closed position, for instance to a Xmas tree instrument panel.

Furthermore, the side protection panel can also comprise a secondary door hingedly attached to the hatch. Such a secondary door can leave an access opening that is adjacent to an adjacent hatch when the secondary door and the said adjacent hatch are both in opened positions. Preferably there is arranged one hatch for each well slot. As will appear from the example description further below, this secondary door renders it possible for an ROV to access the space between two adjacent Xmas trees even when the hatch comprising said secondary door is closed.

According to a further embodiment the template comprises a wireline deflector arranged in a gap between adjacently arranged hatches. The deflector will prevent wirelines, such as trawl wirelines, from entering the gap. Such entrance could cause the trawling equipment to get stuck in the template, which can cause large forces from the cable as the trawling crew attempt to release it.

In the embodiment comprising a wireline deflector, the wireline deflector is preferably attached to a first of said adjacently arranged hatches, and the second hatch comprises a deflector guiding element. The guiding element is adapted to lift away said deflector when the second hatch is moved from an open position to a closed position. Thereby the deflector is moved out of the moving path of the second hatch when this is closing. The deflector is in this way guided into a position in which it partly overlaps both of said adjacent hatches. As will become apparent from the drawings referred to in the example description below, the deflector is advantageously arranged in connection with fluctuating edges of said hatches.

Preferably the template has a plurality of Xmas trees arranged in said well slots, wherein at least one of said Xmas trees has a Xmas tree connection interface which is facing an adjacent Xmas tree, said Xmas tree connection constituting a fluid connection to manifold connection pipes. I.e. in this embodiment the Xmas tree connection interface is arranged between two adjacent Xmas trees. Thus, said manifold connection interface can be operated by an ROV situated at least partly in the space between said one Xmas tree and said adjacent Xmas tree. The ROV can preferably access said space both when just one of the adjacent hatches is in an open position and when both of the adjacent hatches are in an open position, in the first case partly through said secondary door.

With such a solution, even with a template with more than four well slots, for instance six or eight slots, all the Xmas tree connections to the manifold can be operated by an ROV. Hence there is no need for a dedicated tool for such operation.

Preferably the top protection cover and a side protection panel have a substantially horizontal and vertical extension, respectively.

EXAMPLE OF EMBODIMENT

While essential features of the present invention have been described above, a more detailed example of embodiment is given in the following with reference to the accompanying drawings, in which FIG. 1 is a perspective view of a subsea well template according to the prior art;

Figure 1:
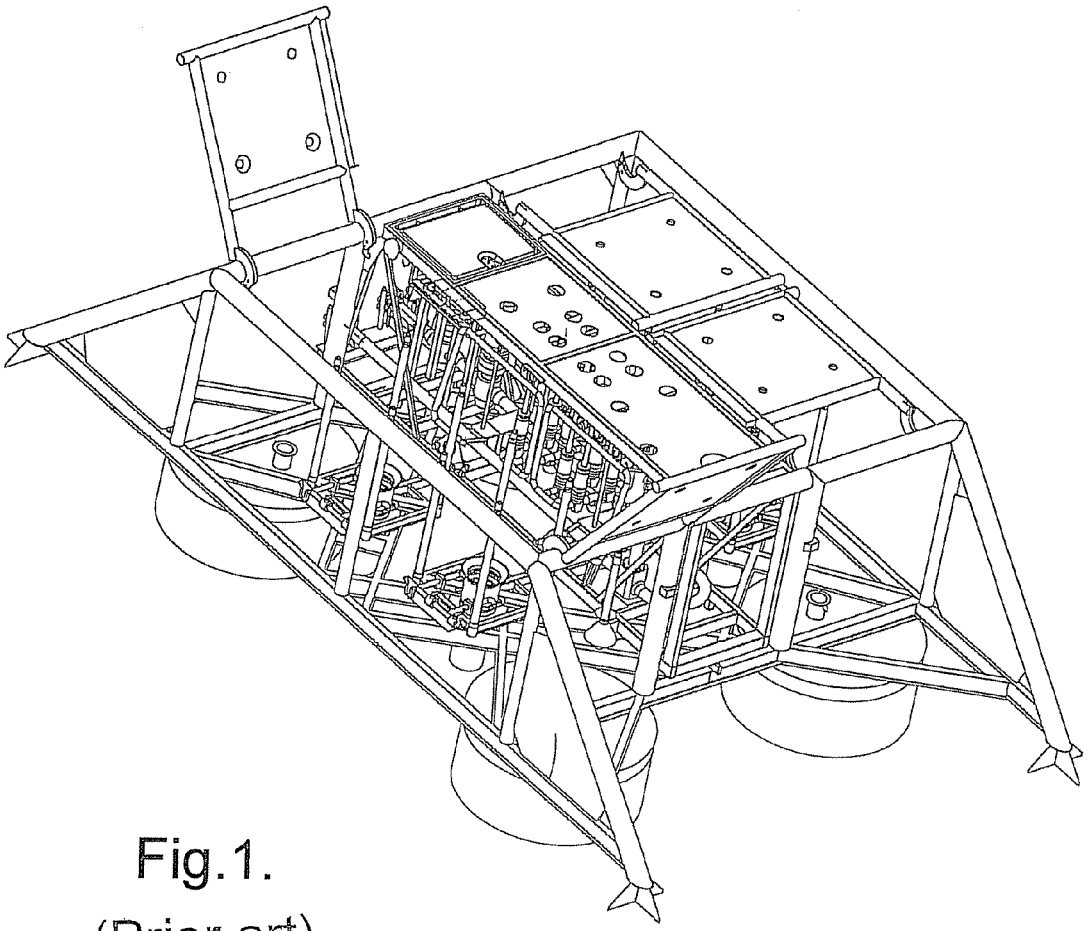
Fig.1. (Prior art)

FIG. 1 shows a subsea well template according to the prior art, with four well slots of which two slots are arranged on each side of a manifold with a longitudinal axis and longitudinal sides. The template has a robust framework with protective hatches arranged on top of it. The protective hatches fluctuate with the top protection cover of the manifold, thereby forming a substantially plane upper surface.

Figure 2:
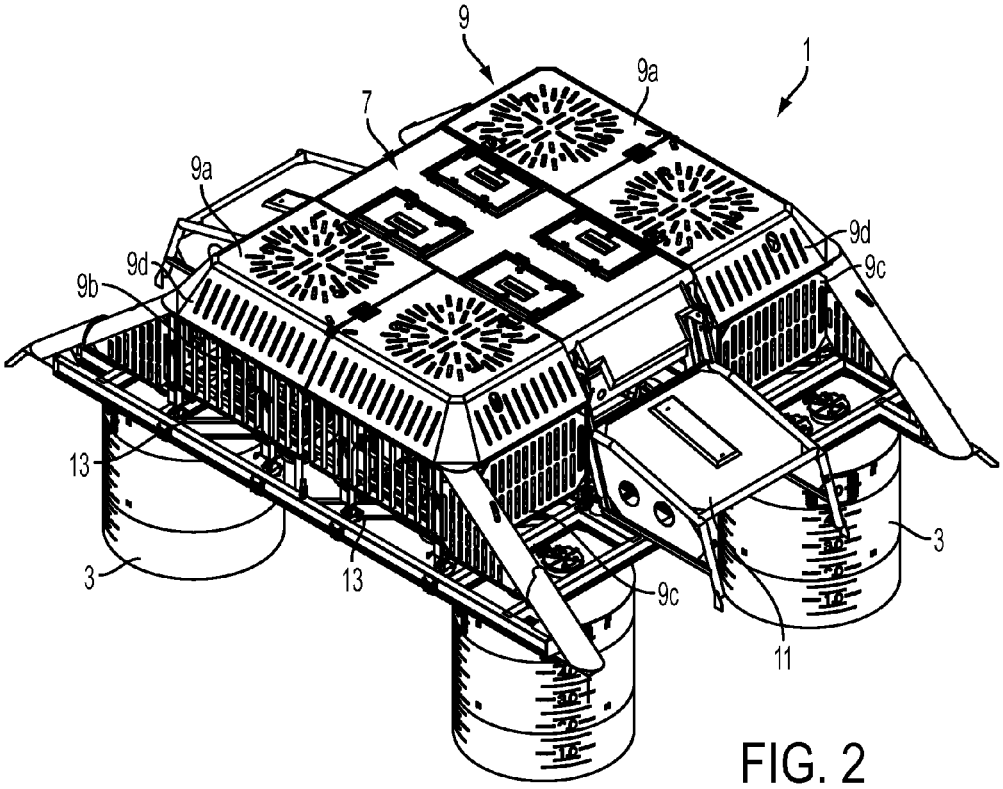
FIG. 2 is a perspective view of a subsea well template according to the present invention, with all hatches in a closed position.
Figure 3:
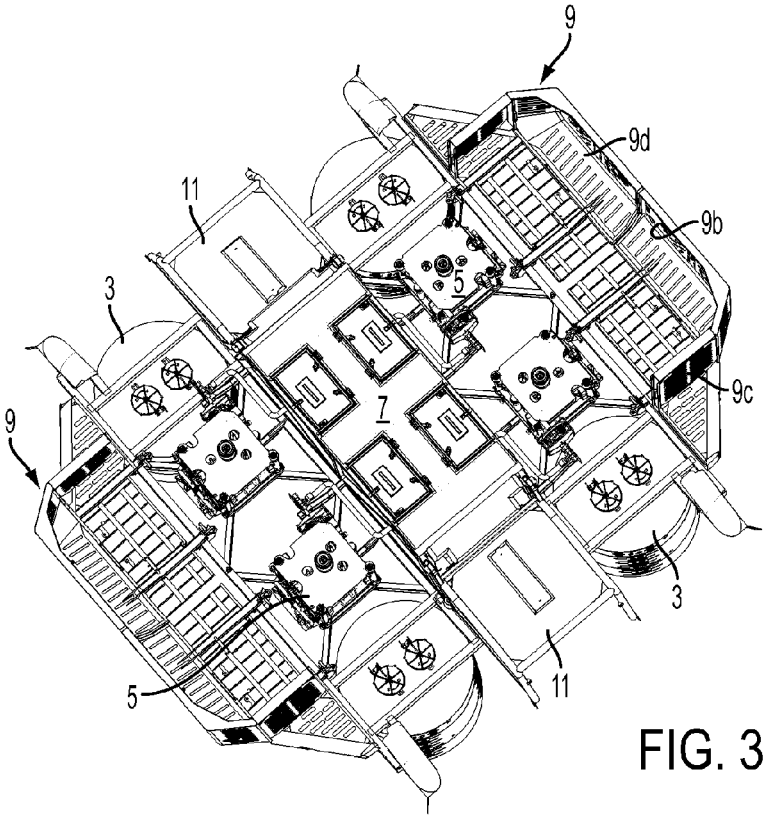
FIG. 3 is a perspective view of the template in FIG. 2, with all the hatches in an open position and four Xmas trees installed.

FIGS. 2 and 3 show a subsea well template 1 according to the invention. The template 1 is anchored to the seabed (not shown) with four suction anchors 3. It has four well slots of which each has a Xmas tree 5 installed (FIG. 3). Between the two pairs of well slots with Xmas trees 5, there is arranged a manifold 7 with a longitudinal axis and longitudinal sides. The two longitudinal sides each face one pair of Xmas trees 5. At each end of the manifold 7, there is arranged a sea-line protection cover 11.

For each well slot the template 1 comprises one hatch 9. Thus, the shown template 1 has four hatches 9. The hatches 9 can pivot about a pivot axis, between a closed and open position. The pivot axis is defined by hinges 13 to which the hatches 9 are attached.

The hatches 9 can be opened by pulling connected wires or by operating a hydraulic cylinder (not shown).

The closed position is shown in FIG. 2 whereas the open position is shown in FIG. 3. When in the open position, the hatches 9 have pivoted in a direction away from the centrally arranged manifold 7, revealing the Xmas trees 5 in the well slots. One should note that when in the open position, there is no remaining framework above the well slots or in the area of the manifold 7 (except any framework of the manifold itself). Thus, the manifold 7 can be lowered or pulled up into or out of position between the Xmas trees 5, even with the sea-line protection cover arranged to it, without risk of colliding with the template 1.

The hatches 9 have a top protection cover 9*a*, a first side protection panel 9*b* and a second side protection panel 9*c*. The top protection cover 9*a* is substantially horizontal when in the closed position, whereas the first and second side protection panels 9*b*, 9*c* are substantially vertical. However, one can also imagine them to have another angle, provided that the top protection cover 9*a* has an extension with a horizontal component and the side protection panels 9*b*, 9*c* have extensions with vertical components. In the shown embodiment, the hatches also have inclined transition faces 9*d* which extend between the top protection cover 9*a* and the two side protection panels 9*b*, 9*c*, respectively.

It should be noted that with a template according to the invention with more than four well slots, for instance six or eight slots, there could be arranged hatches above the intermediate well slots without any second side protection panels.

Figure 4:
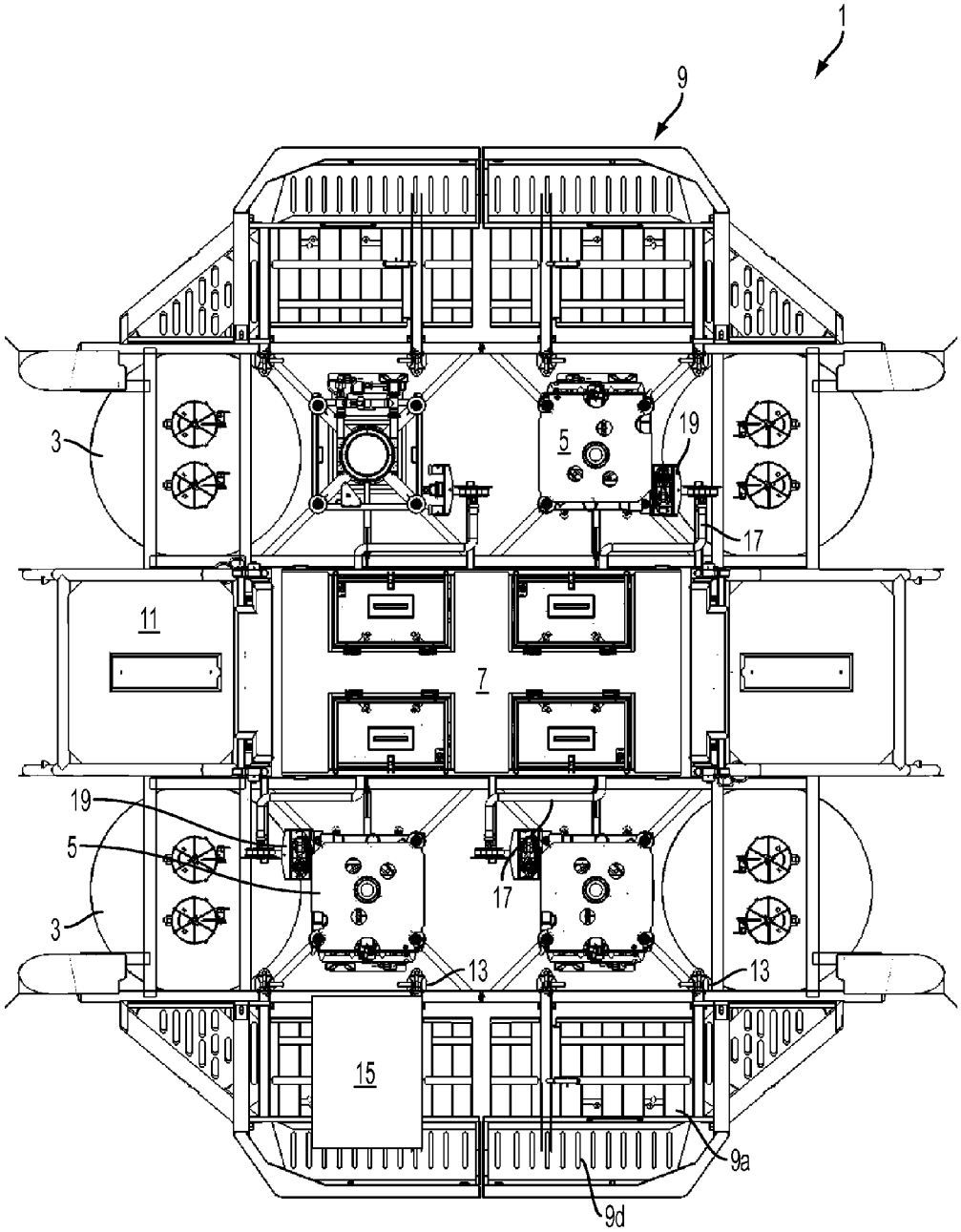
FIG. 4 is a top view of the template in FIG. 3, with only three Xmas trees.

FIG. 4 shows a top view of the template 1 in FIGS. 2 and 3, with all the hatches 9 in the open position, but with only three Xmas trees 5. The hatches 9 are pivoted about 90 degrees out from the Xmas trees 5, rendering an ROV operation space above the hatch 9, or the first side protection panel 9*b*, and the pivot axis (hinges 13). This space is capable of accommodating an ROV 15 that is situated to operate an ROV interface (not illustrated) of the Xmas tree 5. In the figures, the ROV 15 is only schematically illustrated.

The dotted circle with reference number 6 indicates a free space for further equipment such as a blowout preventer (BOP) when the hatches 9 are in the open position.

Figure 7:
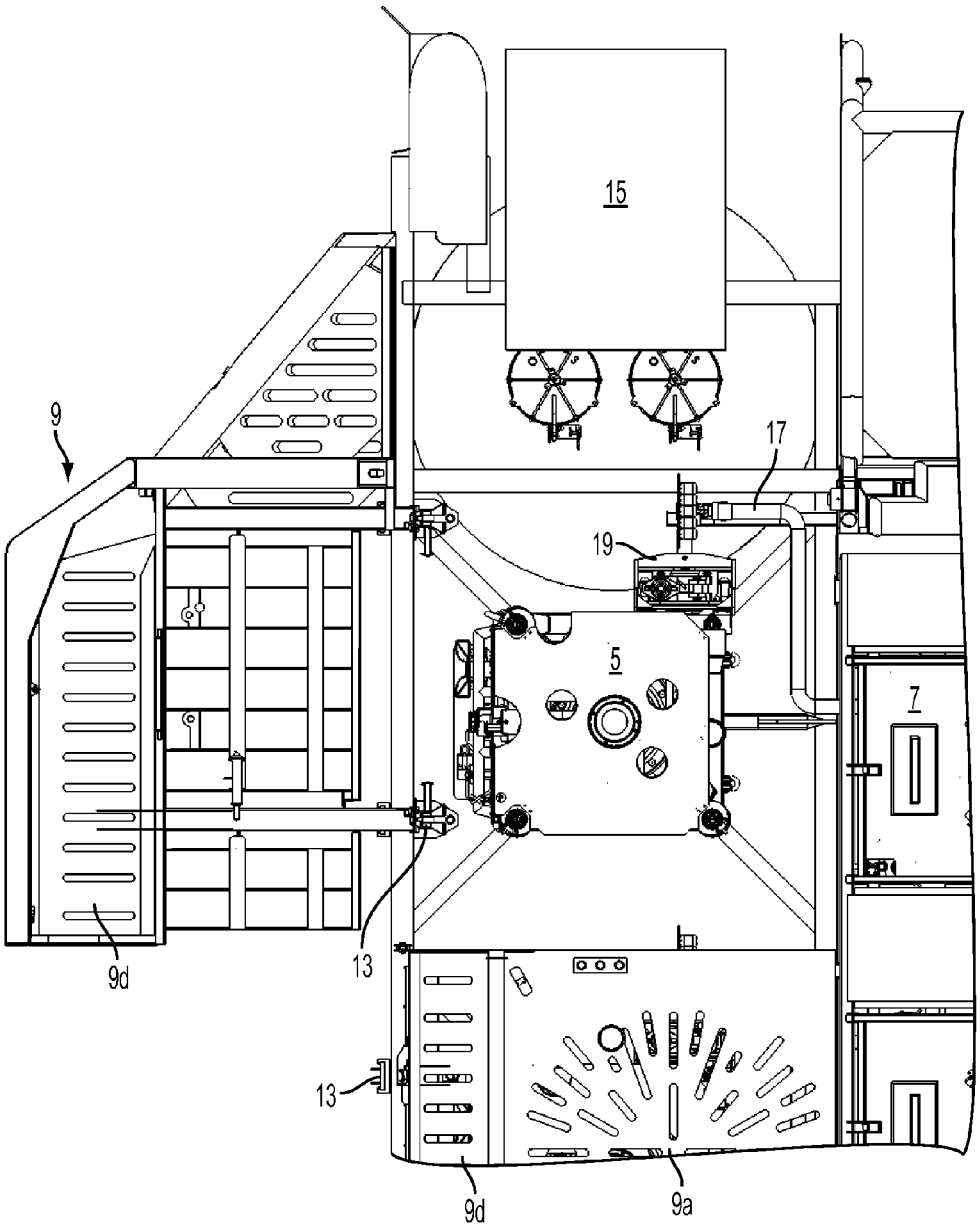
FIG. 7 is an enlarged top view of a part of the template, with an ROV in yet another operating position.

In FIG. 4 are also shown manifold connection pipes 17 for fluid connection between the Xmas trees 5 and the manifold 7. As appears from FIG. 4, in this embodiment all the Xmas trees 5 are connected to the manifold 7 with Xmas tree connection interfaces 19 that connect to the manifold connection pipes 17. Furthermore, all the Xmas tree connection interfaces 19 are arranged on the same side of the Xmas tree 5 with respect to the manifold 7. This position is a position with respect to the Xmas tree 5 at a substantially 90 degrees clockwise rotation out from the manifold 7. That means that from the perspective of the ROV 15 approaching any Xmas tree 5 from the side opposite of the manifold 7, every Xmas tree 5 will have the same configuration of the Xmas tree connection interface 19. A Xmas tree connection interface 19 could also be arranged on the opposite side of the Xmas tree. Preferably, however, they should all be arranged on the same side of the Xmas tree 5 with respect to the access direction of the ROV 15. It should be noted however, that for the Xmas trees 5 arranged in the position of the one at the lower, right corner in FIG. 4, the ROV 15 will preferably access the Xmas tree connection interface 19 from the right hand side, i.e. accessing in a direction parallel to the longitudinal axis of the manifold 7. This is illustrated in FIG. 7. The same applies for a Xmas tree 5 arranged in the opposite upper, left well slot of the template 1 in FIG. 4.

Figure 5:
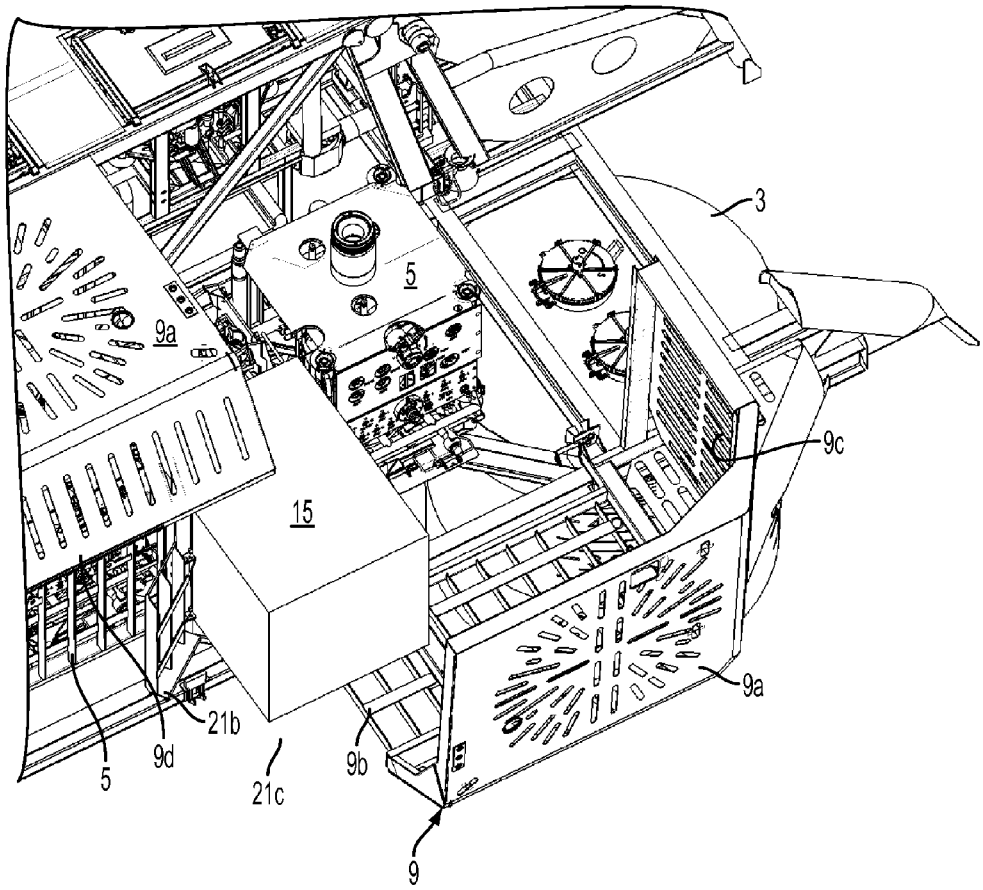
FIG. 5 is an enlarged perspective view of a part of the template and an ROV in an operating position.

It is now referred to FIG. 5, where the ROV 15 is shown in a position to operate the Xmas tree connection interface 19 (not shown in FIG. 5 due to the ROV in front of it). The ROV 15 has moved partly into the space between the left and right (barely visible) shown Xmas trees 5. Differing from FIG. 4, the template 1 in FIG. 5 is shown with the hatch 9 covering the Xmas tree 5 on the right hand side in the closed position. The hatch 9 on the left hand site is in the open position. In order to render a sufficiently large access space for the ROV 15, the first side protection panel 9*b* of the right hatch 9 in FIG. 5 is provided with a secondary door 21*b*. When the secondary door 21*b* is in the open position, a part of the first side protection panel 9*b* of the hatch 9 on the right hand side will be pivoted away, leaving an opening 21*c* for the ROV 15.

Note that if the hatches 9 covering both the left and right Xmas trees 5, or well slots respectively, where in the open position (as in FIGS. 3 and 4), the ROV 15 would also be able to position itself into the operating position shown in FIG. 5. However, it is normally required that the adjacent well slots or Xmas trees 5 are protected while operating above a Xmas tree 5. Thus, all the hatches 5 will normally only be open simultaneously when installing the manifold 7.

Figure 6:
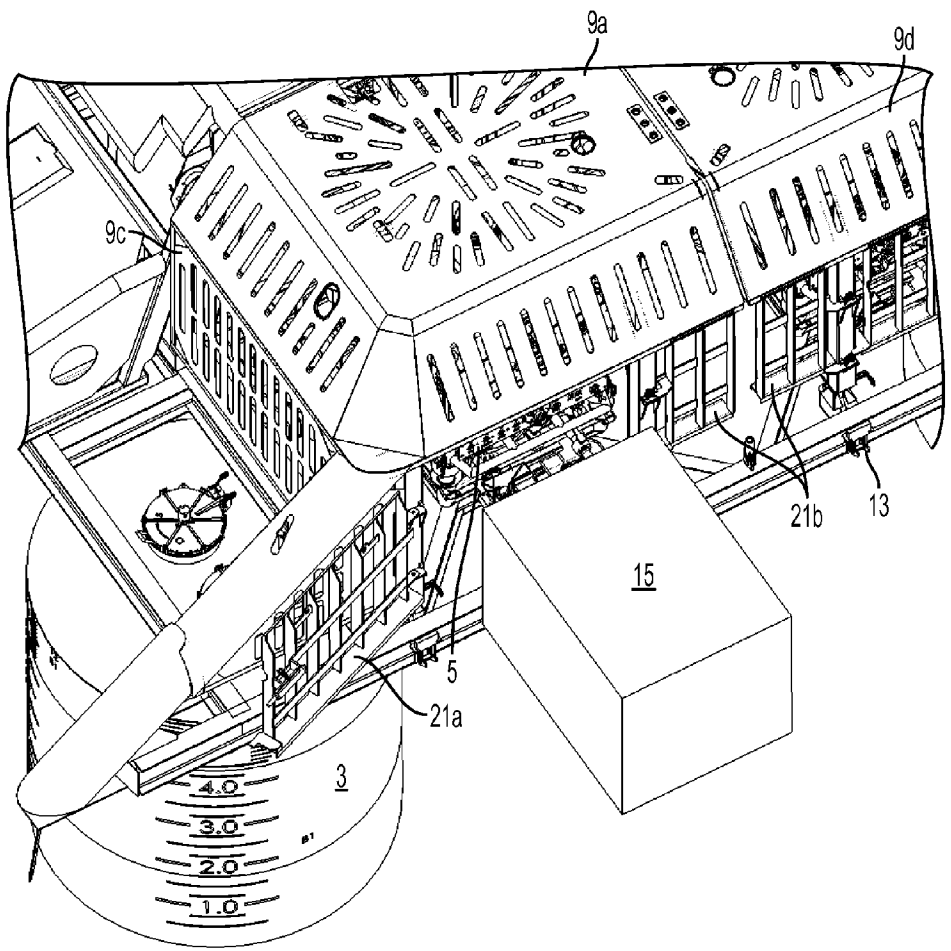
FIG. 6 is an enlarged perspective view of a part of the template and an ROV in a further operating position.

Referring to FIG. 6, all hatches 9 are in the closed position. In this figure, the ROV 15 is shown in an operating position in which it can operate an ROV interface of the Xmas tree 5, such as an instrument panel (not shown). In order to access, a primary door 21*a* of the first side protection panel 9*b* is opened. Thus, the Xmas tree 5 can be operated with the ROV without the need to open the hatches 9.

As briefly mentioned above, when operating the Xmas tree connection interface 19 of the Xmas tree 5 in the lower, right position in FIG. 4, the ROV 15 will access in a direction parallel to the longitudinal axis of the manifold 7, as shown in FIG. 7. In FIG. 7, the lower, right hatch 9 is in the open position, rendering ROV access space on the right hand side of the Xmas tree 5 in the shown drawing.

Figure 8:
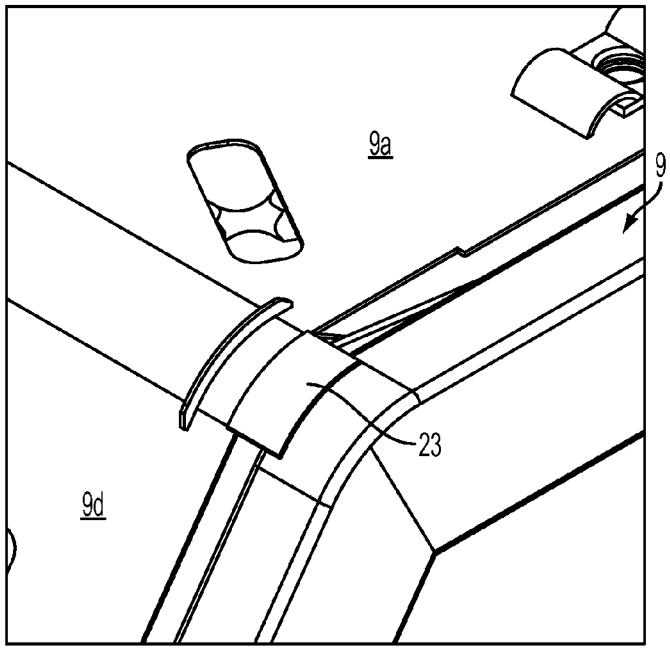
FIG. 8 is an enlarged perspective view of a gap between two adjacent template hatches.
Figure 9:
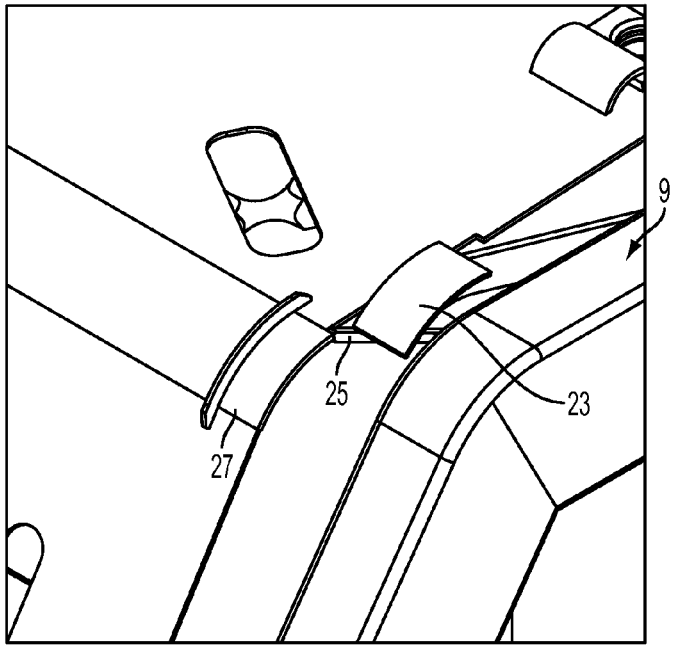
FIG. 9 is the same view as in FIG. 8, with one of the hatches in a partly pivoted position.

Referring now to FIGS. 8 and 9, there is shown a wire-line deflector 23 arranged in the gap between two adjacent hatches 9. Such a gap can for instance be 0.5 cm. Preferably, the deflector 23 is arranged in such way that it partly overlaps the two adjacent hatches 9, in the position of the edge running between the top protection cover 9*a* and the inclined transition faces 9*d*. Deflectors 23 are preferably arranged between each adjacent hatch 9 and serve to prevent wire-lines, such as a trawl wire-line (not shown), to penetrate into the gaps between adjacent hatches 9. In a particularly advantageous embodiment the deflector 23 is attached to a first hatch 9, whereas a deflector guiding element 25 is attached to the facing adjacent hatch 9. This is shown in FIG. 9. When the hatch 9 on the right hand side in FIG. 9 is pivoted into the open position, the deflector 23 will move along with the hatch 9 itself. However, when the hatch 9 on the left hand side in FIG. 9 is pivoted out from the closed position, the deflector 23 will be lifted by an edge portion 27 of the left hatch 9, until it slides of the edge portion 27. When the left hatch 9 is pivoted back into the closed position, the deflector guiding element 25 will engage the deflector 23 and lift it sufficiently to slide it onto the surface of the edge portion 27. In this way, the wire-line deflector 23 is accommodated to overlap both hatches 9 while still making it possible for both adjacent hatches 9 to move in and out of the closed position.

Figure 10:
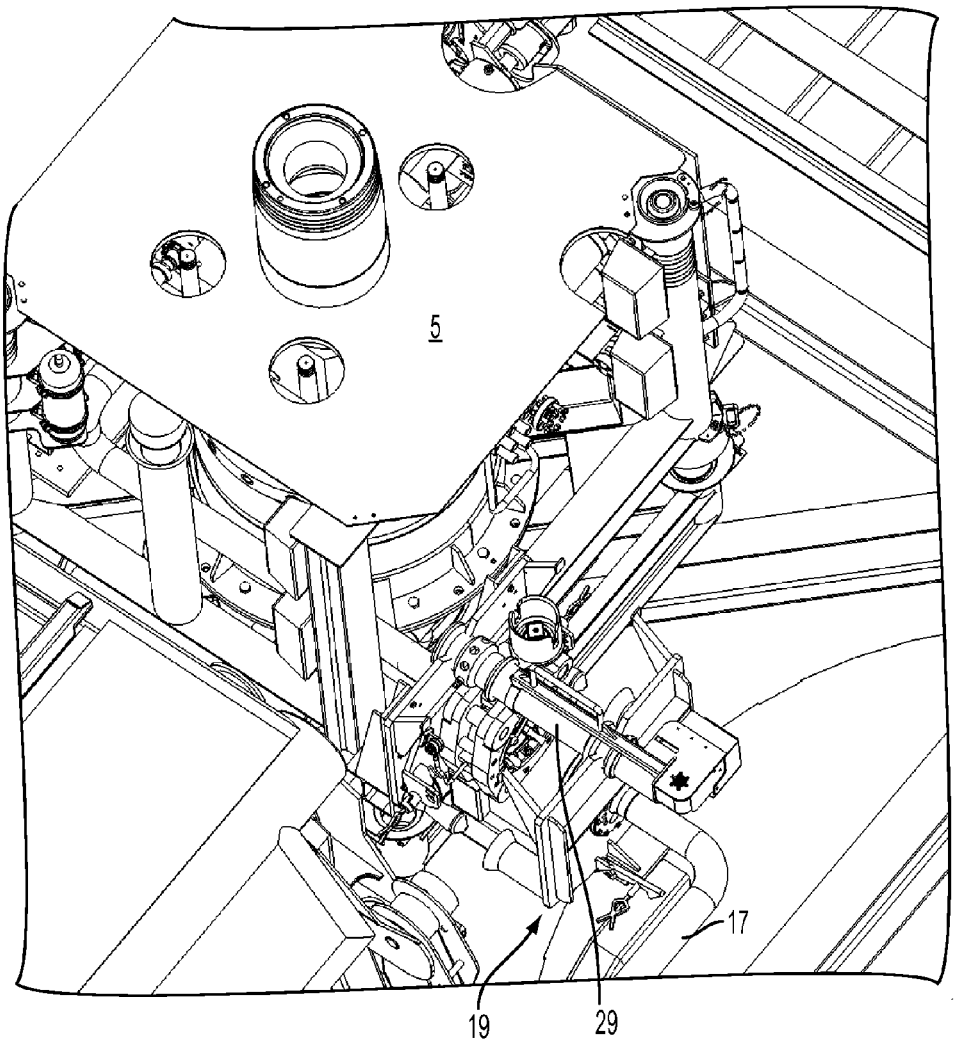
FIG. 10 is an enlarged perspective of a connection arrangement for providing fluid connection between a Xmas tree and the manifold.

In FIG. 10 is shown a connection arrangement for providing fluid connection between a Xmas tree 5 and the manifold 7. The connection arrangement comprises an ROV-operable hydraulic piston 29 which is employed by the ROV 15 to pull the facing sides of the connection arrangement together into a secure fluid connection. The connection arrangement connects to the Xmas tree connection interface 19 (FIG. 4). The arrangement may be operated by an ROV 15 in the position indicated in FIG. 5.

In one embodiment, the hatches 9 can be readily releasable and attachable from the rest of the template 1. Thus, when lowering or elevating the template 1, its weight is reduced correspondingly. In addition the added mass resulting from the hatches when moved in water is reduced, thereby reducing the requirements on the installation equipment dimensions.

The invention claimed is:

1. A subsea well template comprising:

a plurality of subsea well slots for forming a plurality of subsea wells therethrough;

a manifold receptacle arranged between at least two oppositely-disposed subsea well slots of the plurality of subsea well slots;

a plurality of template hatches for protection of well components including a Xmas tree;

wherein said plurality of template hatches comprise at least a top protection cover and a side protection panel;

wherein said plurality of template hatches are arranged to pivot between a closed position and an open position about a pivot axis arranged on an edge opposite the manifold receptacle such that the plurality of template hatches associated with the at least two oppositely-disposed subsea well slots open in opposite directions away from the manifold receptacle; and wherein when in an open position, the subsea well template exhibits absence of a framework extending up towards a top of the subsea well template.

2. The subsea well template according to claim 1, wherein:

said manifold receptacle is arranged to receive a manifold with a longitudinal direction and that said plurality of template hatches are adapted to pivot between the closed and the open position about the pivot axis extending substantially parallel to said longitudinal direction; and at least two sets of well slots are arranged in a row on respective sides of the longitudinal direction of the manifold.

3. The subsea well template according to claim 1, wherein said pivot axis is arranged below an ROV operation space, the ROV operation space being capable of accommodating an ROV that is situated to operate an ROV interface of said Xmas tree.

4. A subsea well template comprising:

a plurality of subsea well slots for forming a plurality of subsea wells therethrough, said subsea well template comprising a plurality of template hatches for protection of well components including a Xmas tree;

a manifold receptacle arranged between at least two oppositely-disposed subsea well slots of the plurality of subsea well slots;

wherein each template hatch of said plurality of template hatches comprise at least a top protection cover and a side protection panel;

wherein each template hatch of the plurality of template hatches pivots between a closed position and an open position about a pivot axis arranged on an edge opposite the manifold receptacle such that a pair of template hatches associated with the at least two oppositely-disposed subsea well slots open in opposite directions away from the manifold receptacle;

wherein each side protection panel of the plurality of template hatches comprises a secondary door hingedly attached to a template hatch of the plurality of template hatches, said secondary door leaving an access opening adjacent to an adjacent template hatch position when said secondary door is in an opened position; and wherein when the secondary door is in the opened position, the access opening is only partially encircled by the template hatch, as the access opening faces towards the adjacent template hatch position.

5. The subsea well template according to claim 4, wherein each side protection panel of the plurality of template hatches comprises a primary door hingedly attached to the template hatch of the plurality of template hatches.

6. A subsea well template comprising:

a plurality of subsea well slots for forming a plurality of subsea wells therethrough, said template comprising a plurality of template hatches for protection of well components including a Xmas tree;

a manifold receptacle arranged between at least two oppositely-disposed subsea well slots of the plurality of subsea well slots;

wherein said plurality of template hatches comprise at least a top protection cover and a side protection panel;

wherein each template hatch of the plurality of template hatches pivots between a closed position and an open position about a pivot axis arranged on an edge opposite the manifold receptacle such that a pair template hatches associated with the at least two oppositely-dispoed subsea well slots open in opposite directions away from the manifold receptacle; and wherein the subsea well template comprises a wireline deflector arranged in a gap between adjacently arranged template hatches of the plurality of template hatches.

7. The subsea well template according to claim 6, wherein said wireline deflector is attached to a first of said adjacently arranged template hatches, and that a second of the adjacently arranged template hatches comprises a deflector guiding element adapted to lift away said wireline deflector when the second of the adjacently arranged template hatches is moved from an open position to a closed position.

8. The subsea well template according to claim 6, wherein the subsea well template has a plurality of Xmas trees arranged in the plurality of subsea well slots, wherein at least one of said Xmas trees has a Xmas tree connection interface which is facing an adjacent Xmas tree, said Xmas tree connection interface constituting a fluid connection to manifold connection pipes.

9. The subsea well template according to claim 8, wherein said Xmas tree connection interface can be operated by an ROV situated at least partly in a space between one of said Xmas trees and said adjacent Xmas tree.

10. The subsea well template according to claim 6, wherein each top protection cover of the plurality of template hatches and each side protection panel of the plurality of template hatches have a substantially horizontal and vertical extension, respectively.

* * * * *